US005956773A

United States Patent [19]

LaMantia

[11] Patent Number: 5,956,773

[45] Date of Patent: Sep. 28, 1999

[54] VISOR GUARD

[76] Inventor: Mark LaMantia, 5 Fair Oaks Ave., Methuen, Mass. 01844

[21] Appl. No.: 08/903,165

[22] Filed: Jul. 30, 1997

[51] Int. Cl.[6] ..... A42B 1/06

[52] U.S. Cl. ..... 2/195.1; 2/181; 2/181.4

[58] Field of Search ..... 2/181, 195.1, 209.13, 2/181.2, 181.4

[56] References Cited

U.S. PATENT DOCUMENTS

| | | | |
|---|---|---|---|
| 4,468,817 | 9/1984 | Nunnery et al. | 2/181 |
| 5,410,761 | 5/1995 | Connelly et al. | 2/209.13 |
| 5,519,891 | 5/1996 | Peters et al. | 2/209.13 |
| 5,659,896 | 8/1997 | Taylor | 2/209.13 |
| 5,687,425 | 11/1997 | Blosser | 2/209.13 |
| 5,701,607 | 12/1997 | Kaiser | 2/209.13 |

FOREIGN PATENT DOCUMENTS

| | | | |
|---|---|---|---|
| 736700 | 11/1932 | France | 2/195.1 |

*Primary Examiner*—Diana L. Biefeld

*Attorney, Agent, or Firm*—Wolf, Greenfield & Sacks, P.C.

[57] ABSTRACT

A visor guard for covering the visor of a baseball-type cap having a crown with a headband about the edge of the crown and an adjusting strap at the rear of the headband for altering the cap size. The guard comprises a pocket made of a washable material, preferably terry cloth, defined by upper and lower panels. The shapes of the panels generally conform to the shape of the visor to be covered and the panels are secured together about their edges which conform to the free edge of the visor. The remainder of the edges of the panels are not connected together so as to form an opening through which the visor may be inserted into the pocket. A sweatband is connected to one of the edges of the opening and is positioned to lie against the inside of the headband and against the forehead of the wearer of the cap, and a retainer is connected to the sweatband and may be tucked in between the headband and the crown of the cap to hold the guard in place on the visor. In accordance with one embodiment of the invention, a sleeve made of terry cloth encircles the strap attached to the headband, and the sleever acts as a sweatband against the back of the head together with the sweatband on the visor guard when the cap is worn.

10 Claims, 2 Drawing Sheets

VISOR GUARD

This invention relates to a novelty item for headwear and more particularly comprises a visor guard for caps and a complementary sleeve for covering the size adjustment strap or straps at the back of conventional caps.

The visor guard of the present invention is capable of performing one or more of the following functions:

(a) prevent the visor of the cap from becoming soiled;

(b) cover a permanently soiled cap visor;

(c) provide a decorative addition to the cap by virtue of its color or indicia such as a design, logo, cartoon character, etc.

(d) improve the comfort of the cap by providing a sweatband across the forehead of the wearer;

(e) create a uniform headwear for a team or other group wearing otherwise dissimilar baseball-type caps;

(f) enable any baseball-type cap to be converted to a marketing device; etc.

The visor guard preferably is applied to a cap in combination with a complementary sleeve that covers most or all of the size adjusting strap or straps at the rear of the cap. The sleeve may be made of a color or carry other indicia which is related to the color and/or indicia applied to the visor guard. The sleeve when made of a soft absorbent material will also increase the comfort of the cap to which it is applied by acting as a sweatband and cushion against the head, particularly when the cap is turned around on the head, a popular current style for the young.

In accordance with the present invention, the visor guard comprises a pocket preferably made of a soft, washable and flexible material which is sized and shaped to snugly receive the visor of a baseball cap. The pocket is closed about the major curved edge of the visor but is open at one side to enable the visor to be inserted in the pocket. The pocket along one side of the opening carries a sweatband and retainer that respectively lie against the exposed surface of the headband of the cap inside the crown of the cap and behind the headband between it and the crown. The retainer is made of a rather stiff material such as plastic flexible enough to conform to the curvature of the crown when worn on heads of differing shapes but sufficiently rigid so that it can not readily be pulled out from behind the headband so as to loosen the guard on the cap visor.

The sleeve is also preferably made of a soft, absorbent material and may either be permanently tube-shaped requiring that the strap or straps be threaded therethrough or be openable lengthwise and releasably closed by a hook and loop type Velcro® closure or similar device so that it can be wrapped around the strap or straps after the cap size has been set and the strap or straps closed.

The invention will be better understood and appreciated from the following detailed description read in conjunction with the accompanying drawings.

DETAILED DESCRIPTION

Figure 1:
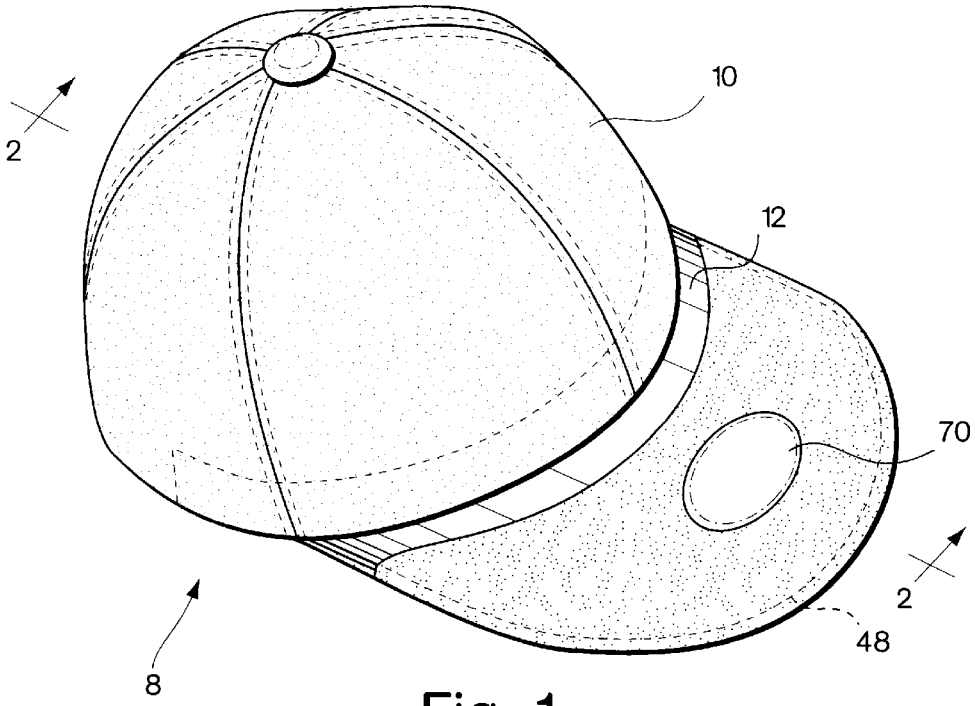
FIG. 1 is a perspective view of a baseball-type cap to which the visor guard of the present invention is attached.

The baseball-type cap 8 shown in the drawings to which the visor guard of the present invention is applied includes a crown 10, visor 12, headband 13 and adjustment straps 14 and 16 attached to the opposite ends of the headband 13. The straps 14 and 16 enable the wearer to alter the diameter of the crown so that the cap fits comfortably on the head. The cap is of conventional construction and requires no special features to enable it to receive the visor guard 20 and sleeve 22 of the present invention. While the size adjustment in the cap illustrated is achieved by a pair of straps 14 and 16 having poppets and holes on the straps to secure the straps together, other well known devices such as a single strap and slide clamp may be connected to the ends of the headband and achieve the same purpose.

The visor guard 20 is provided to protect the visor 12 of the cap 8 from becoming soiled and/or decorates the visor with an insignia, trademark, cartoon character or other fancified indicia to enhance the "look" of the cap. The visor guard may also improve the comfort of the cap 8 by providing a comfortable and highly functional sweatband against the wearer's forehead. The visor guard itself is readily washable so that it can always be kept clean. Similarly, the sleeve 22 on the adjustment strap or straps improves the appearance and comfort of the cap and may carry indicia which complements that of the visor guard. In the preferred construction of this invention, both the visor guard 20 and the sleeve 22 are made of a terry cloth material which is soft, highly absorbent, washable and inexpensive, all most desirable properties for the guard and sleeve.

The visor guard 20 includes a pocket 30 made of upper and lower panels 32 and 34 that are similarly shaped and oriented one above the other. The panels 32 and 34 have curved front edges 36 and 38 respectively that are identically shaped and stitched together as suggested at 40 to close the front end of the pocket 30. The remaining portions 42 and 44 respectively of the edges of the panels 32 and 34 are not connected together but rather form an opening 46 into the pocket 30 as shown particularly in FIGS. 2 and 5. When the guard is mounted on the cap, the visor is inserted through the opening 46 so that the front curved edge 48 of the visor engages the pocket 30 at or near the seam formed by the stitching 40. The curved front edge 48 of the visor closely approximates the shape of the front of the pocket so that the pocket is filled by the visor, and the top and bottom panels 32 and 34 lie smoothly against the upper and lower surfaces 50 and 52 of the visor.

Figure 2:
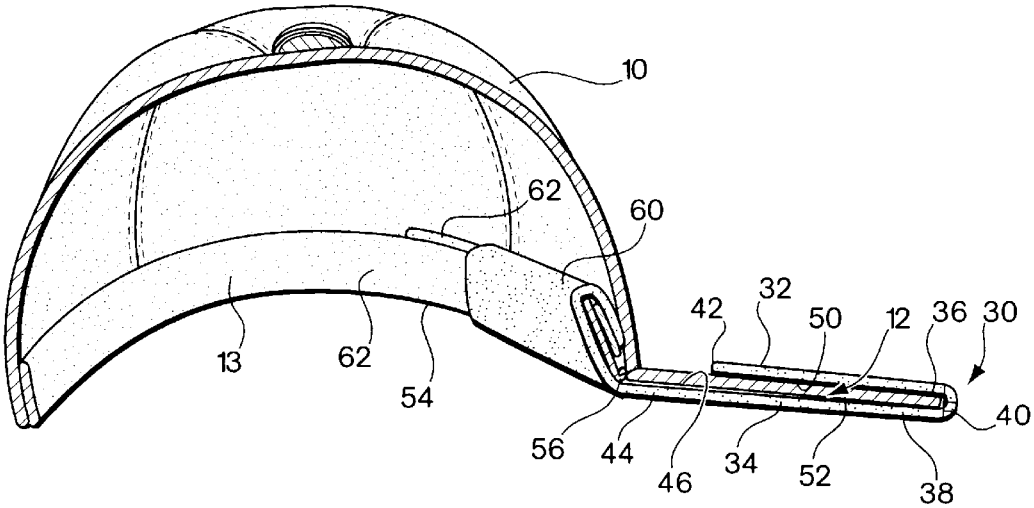
FIG. 2 is a cross-sectional view of the cap and visor guard of FIG. 1 taken along the section line 2—2 in that figure.
Figure 4:
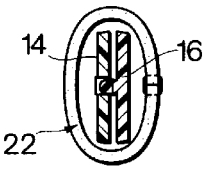
FIG. 4 is a cross-sectional view of the sleeve and adjusting strap taken along section line 4—4 of FIG. 3.

It will be noted in FIGS. 2 and 4 that the edges 42 and 44 do not exactly coincide with one another in the embodiment shown. The larger bottom panel 34 extends rearwardly so that its rear edge 44 lies under the edge 56 of the crown of the cap to the lower edge 54 of the headband while the rear edge 42 of the upper panel lies outside of and in front of the crown above the rear portion of the upper surface of the visor.

In the embodiment of the visor guard 20 illustrated, the bottom panel 34 of the guard carries a sweatband 60 that lies against the exposed surface 62 of the headband 13 when the guard is installed on the cap 8. The sweatband 60 may either be an integral part of the panel 34 or a separate strip sewn or otherwise attached to the rear edge 44 of the bottom panel. In the embodiment shown, the sweatband 60 is an integral part of the lower panel 34 and made of the same material, preferably terry cloth.

Figure 5:
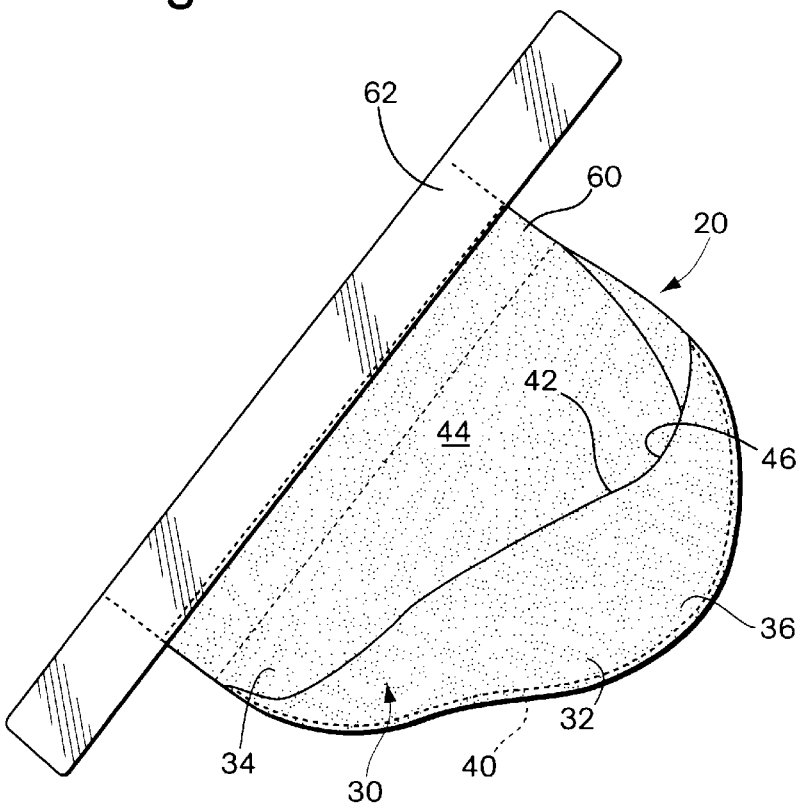
FIG. 5 is a perspective view of the visor guard of the present invention shown removed from the cap.

The sweatband 60 carries a retainer band 62 preferably made of stiff plastic material of substantial length and attached edge to edge with the sweatband as clearly shown in FIG. 5. The two are shown stitched together but other means of attachment such as adhesive or rivets may be used. The retainer band 62 is shown in the illustrated embodiment to be longer than the sweatband but the two may be the same length.

When the visor guard 20 is slipped onto the visor 12 of the cap 8, the sweatband 60 and retainer band 62 are pulled toward the crown 10 of the cap and the retainer band is pulled up, over and down behind the headband 13 as shown in FIG. 2. In that position, the sweatband 60 lies against the exposed surface 63 of the headband 13 and on the forehead when the cap is worn.

Figure 3:
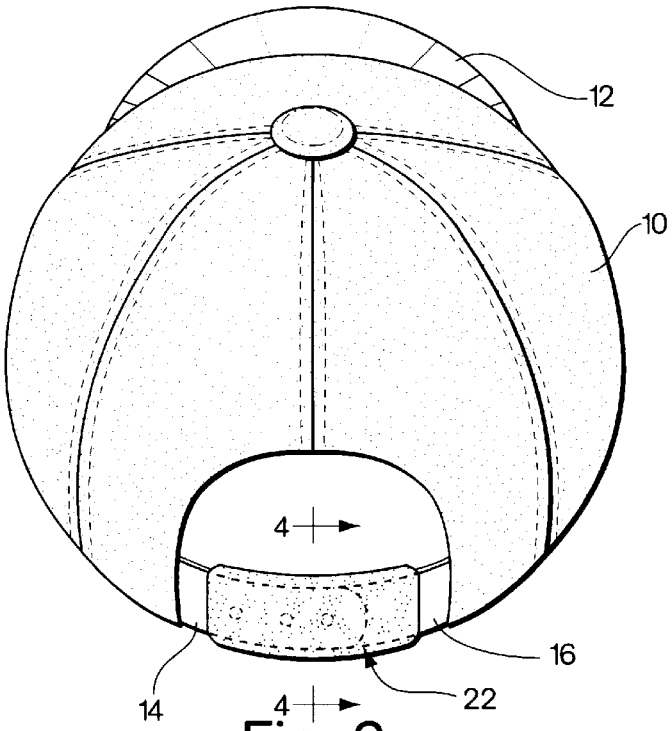
FIG. 3 is a rear perspective view of the cap shown in FIG. 1 and further showing the application of a sleeve to the adjustment strap of the cap.

The sleeve 22, shown in FIGS. 3 and 4 complements the visor guard of FIGS. 1, 2 and 5. It is a simple stitched sleeve of terry cloth or other material and is of sufficient length to cover at least a substantial portion of the straps 14 and 16 when they are closed. Alternatively, the sleeve 22 may be knitted as a continuous piece without a seam, or an openable fastener such as a Velcro-top closure may be used to enable the sleeve to be applied after the straps are closed. The sleeve may carry decorative material such as a design, logo, cartoon character, color, etc. to complement the decorative material of the visor guard and may also serve as a sweatband at the back of the head (or on the forehead when the cap is worn backwards which is a very popular style with youngsters).

In the embodiment of the invention shown, the visor guard 20 carries a logo 70 which may be that of a sports team, educational institution, etc. and is made of a fabric bearing the color of the same organization, and the sleeve 22 is made of the same color or colors, and may also carry the organization's name. If made of terry cloth, the visor guard 20 and sleeve 22 will add comfort to the wearer of the cap by virtue of its softness and ability to absorb moisture. The visor guard 20 will keep the cap visor 12 clean or hide a soiled visor, and both the guard 20 and sleeve 22 may readily be washed. Because the visor guard 20 and sleeve 22 may be made very inexpensively, it may be sold for a low price or may even be given away as a premium or a memento of some occasion.

From the foregoing description, those skilled in the art will appreciate that modifications of the illustrated embodiment may be made without departing from the spirit of this invention. Therefore, the scope of the invention is not to be limited to embodiments illustrated and described, but rather its scope is to be determined by the appended claims and their equivalents.

What is claimed is:

1. A guard for the visor of a baseball-type cap having a crown with an inside headband for extending across the forehead of a wearer comprising:

a pocket having upper and lower flexible panels of similar size in face-to-face relationship and each having a peripheral edge with a curved portion for approximating the curvature of the forward edge of the visor of the cap to be covered, said curved portions being secured together and said pocket being sized for receiving the visor with the lower panel covering the lower surface of the visor and the upper panel covering the upper surface of the visor said lower panel being made of terry cloth, the remaining portions of the edges of the panels being disconnected from each other to form an opening into the pocket for enabling the visor to be inserted into the pocket, a sweatband attached to the portion of the edge of the lower panel that in part forms the opening in the pocket for lying against an inner surface of the headband in the crown of the cap when the visor is disposed in the pocket, and a retainer attached to the sweatband for insertion between the headband and the crown of the cap to retain the pocket on the visor.

2. A visor guard for the visor of a cap also having a crown, a headband inside the crown about its lower edge and a size adjusting strap secured to the ends of the headband at a rear portion of the crown of the cap comprising:

a pair of panels made of flexible material having first portions of their respective peripheral edges secured together to form a pocket having upper and lower panels for receiving the visor of the cap with said upper and lower panels lying on the upper and lower surfaces of the visor, the peripheral edges of the panels having second portions not secured together to define an opening for enabling the visor to be inserted into the pocket, the second panel being made of terry cloth, and a retainer secured to the second portion of the lower panel for fitting between the headband and the crown of the cap for retaining the guard on the visor with the visor disposed in the pocket.

3. A visor guard as defined in claim 2 wherein the retainer is connected to the lower panel by a sweatband adapted to lie between the surface of the headband and the forehead of a wearer of the cap.

4. In combination with the visor guard as defined in claim 3, a sleeve made of an absorbent material for recovering the strap.

5. In the combination as defined in claim 4, the sweatband and sleeve are both made of terry cloth.

6. A combination cap and visor guard comprising:

a baseball-type cap having a crown, visor and headband with the headband encircling a major portion of an inside of the crown at a lower edge of the crown, said headband having an exposed surface within the crown, a visor guard having a pocket including upper and lower panels which conform generally to the shape of the visor, said panels substantially covering the upper and lower surfaces of the visor, and an extension including a retainer attached to the pocket and extending into the crown and behind the headband between the headband and crown for releasably retaining the pocket on the visor.

7. A combination as defined in claim 6 wherein the extension includes a sweatband between the pocket and retainer for covering a portion of the exposed surface of the headband when the retainer is behind the headband.

8. A combination as defined in claim 6 wherein the visor guard carries ornamental indicia.

9. A combination as defined in claim 8 wherein the cap has a size adjusting strap attached to the headband and a flexible sleeve encircles the strap, the sleeve carrying ornamental indicia related to the indicia on the visor guard.

10. A combination as defined in claim 6 wherein the cap has a size adjusting strap attached to the headband and a flexible sleeve encircles the strap.

* * * * *